US009895600B2

(12) United States Patent
Johnson

(10) Patent No.: US 9,895,600 B2
(45) Date of Patent: Feb. 20, 2018

(54) CHESS GAME VARIANT AND METHOD OF PLAYING THE SAME

(76) Inventor: Charles Johnson, Seattle, WA (US)

( * ) Notice: Subject to any disclaimer, the term of this patent is extended or adjusted under 35 U.S.C. 154(b) by 414 days.

(21) Appl. No.: 13/481,591

(22) Filed: May 25, 2012

(65) Prior Publication Data

US 2014/0062021 A1 Mar. 6, 2014

(51) Int. Cl.
*A63F 3/00* (2006.01)
*A63F 3/02* (2006.01)

(52) U.S. Cl.
CPC ..... *A63F 3/02* (2013.01); *A63F 2003/0088* (2013.01); *A63F 2003/00725* (2013.01); *A63F 2003/00826* (2013.01); *A63F 2003/00876* (2013.01)

(58) Field of Classification Search
CPC ..... A63F 3/02; A63F 2003/00826; A63F 2003/00876; A63F 2003/0088; A63F 2003/00725
USPC ..... 273/260, 261
See application file for complete search history.

(56) References Cited

U.S. PATENT DOCUMENTS 3,856,309 A * 12/1974 Helfgott ..... 273/288
3,902,724 A * 9/1975 Hersey ..... 273/258
4,067,578 A * 1/1978 Chang ..... 273/261
4,249,740 A * 2/1981 Cheney et al. ..... 273/260
5,197,742 A * 3/1993 Bendit ..... 273/239
5,314,189 A * 5/1994 Kerivan ..... 273/260
5,556,099 A * 9/1996 Mardirosian ..... 273/241
6,062,562 A * 5/2000 Pardee ..... 273/248
6,170,825 B1 * 1/2001 Pflum ..... 273/261

* cited by examiner

*Primary Examiner* — Vishu Mendiratta

(74) *Attorney, Agent, or Firm* — Miller Nash Graham & Dunn LLP; Kathleen Petrich

(57) ABSTRACT

A board game that includes a traditional chessboard and two sets of playing pieces, where the playing pieces correspond to that of Western chess, but where each playing piece (possibly save the king) has a top portion and a removable corresponding bottom portion. Each player also is given a second group of top portions that can be interchanged with the original top portions. While game set up and playing piece movement is similar to Western chess, a piece is not "captured" when an opponent lands on the same board square but "converted." The opponent removes the top portion and replaces the piece with a different tone top portion to provide visual indication that the playing piece has been converted to the other side. That converted piece stays on the board instead of being removed with few exceptions. The game ends when one player checkmates the other player's king.

7 Claims, 10 Drawing Sheets

CHESS GAME VARIANT AND METHOD OF PLAYING THE SAME

TECHNICAL FIELD

The present invention relates generally to a chess game variant and a method of playing the same, and, particularly, with chess pieces having convertible top portions to provide visible indication of conversion of the chess piece.

BACKGROUND OF THE INVENTION

The game of chess 1 (Prior Art FIG. 1), premised on the experience of war and conflict, dates back to India in the 6th century during the Gupta empire, and today it is played world-wide according to rules maintained by the World Chess Federation. It is a two-player game. The square board 2 on which it is played consists of 64 squares arranged in an eight-by-eight grid of rows 3 (called "ranks") and columns 4 (known as "files"). Ranks are identified by the numbers 1 to 8 and columns by the letters A to H. The squares alternate between black and white. Each player starts with 16 pieces 5, white for one player, black for the other. The pieces include a king 6, a queen 7, two rooks (or castles) 8, two bishops 9, two knights 10, and eight pawns 11. Each piece moves in its own unique fashion.

In traditional chess, the object of the game is to remove the pieces controlled by one's opponent and maneuver the opposing king into checkmate. During the course of game play special moves are possible such as castling, en passant, and promotion of a chess piece. Today there are many variations on the traditional game of Western chess.

For example, U.S. Pat. No. 6,000,698 to Woodward proposed a form of chess in which captured pieces can be used by the captor. In the game described in this patent, the rules of Western chess and Shogi are combined with an entirely new chess piece design involving an upright stem with a shape denoting the piece's denomination and a direction indicator that identifies the ownership of the piece.

Shogi, often called Japanese chess, dates back to the 16th century. The game is played with 20 flat, wedge-shaped pieces not differing in color on a board of 9 rows and 9 columns. Pieces in Shogi, which differ in size, are marked on their surface with Chinese characters, have other markings on their reverse side, and can be promoted when a piece is turned over. Promotion occurs when a piece reaches the three ranks (or promotion zone) on the far side where the opponent's pieces were set up at the start of the game. The pieces for each player include one king, one rook, one bishop, two gold generals, two silver generals, two knights, two lances, and nine pawns. Ownership of the piece is determined by the direction toward which the piece is pointing, that is, the smaller end points toward one's opponent.

What distinguishes Shogi is its "drop rule," which allows players to return to the board pieces captured from an opponent and use them as one's own. Once captured, a piece may be held "in hand" on a wooden stand at the bottom right corner of the board, then returned to play anywhere on the board. Each drop counts as a move by the player. But a drop cannot capture an opponent's piece. And a drop in the promotion zone does not lead to immediate promotion. Two restrictions must not be violated. First, a pawn cannot be placed on the same column as another unpromoted pawn; and, secondly, a pawn cannot be dropped to bring about an immediate checkmate. Furthermore, in order for pawns, knights and lances to have freedom to move legally, they cannot be dropped on the farthest rank, nor can a knight be placed on the penultimate rank.

SUMMARY OF THE INVENTION

The present invention is directed to a board game for two players that is an improvement to the traditional game of Western chess and Shogi. In the present invention, the board game includes a traditional 64 bi-tonal (e.g., black and white) checkerboard with eight rows and eight columns. Each player has a set of board playing pieces, where the first set of playing pieces is one color and the other set is a different color. Similar to traditional chess, each player has eight pawns, two castles or rooks, two knights, two bishops, one queen, and one king, where the playing pieces are ranked from lowest (pawns) to the highest rank (the king) and the other playing pieces are ranked in descending order: the queen, bishops, knights, and the castles (or rooks). These playing pieces are readily identifiable by size and shape and each playing piece has a top and bottom portion.

However, different from Western chess or Shoji, the top portion of each pawn, castle, knight, bishop, and queen of each playing set is removable from its respective bottom portion. Each playing set further includes an additional top portion for each pawn, castle, knight, bishop, and queen that has a different color than the original top portion. According to one aspect of the invention, the additional top portions are the same color as the opposing player's original playing pieces. Further, each additional top portion may be the same size and shape of the original top portion, such that the new top portion of a playing piece may look exactly like the original top portion for that same playing piece, save that the color of the top is different than the bottom portion of the playing piece.

In one form of the invention, each top portion, regardless of whether it's an original top portion or the additional top portion, of a playing piece includes a lower surface and an outwardly-extending protuberance. Each bottom portion includes an upper surface in which a slot or opening of a size to receive the protuberance of the top portion is defined. Each top portion is capable of being seated atop of its corresponding bottom portion by inserting the protuberance of the top portion into the slot of the bottom portion and where the lower surface of the top portion closely confronts the upper surface of the bottom portion.

In addition to the game board and novel sets of playing pieces, the invention further includes a method of playing a game in which each piece is intended to move as in traditional Western chess. For example, a king can move only one square, but in any direction. A queen can move in any direction (up, down, right, left, and diagonal) and travel as many squares within that direction as is available or capable of capturing an opponent's piece. A bishop can only move diagonally. One of the two bishops is moveable within one (color) tone of squares on the board; the other bishop can only move on the other (color) tone. A knight can only move within an "L" shaped configuration such as two squares over and one square "up" or one square over and two squares "up" so that it must always move to a square tone different than the square tone it moved from. A castle can only move vertically or horizontally. And a pawn can only move one space directly ahead except for two exceptions: (1) a pawn can move two squares on its first move and (2) when a pawn captures a piece, it can only do so by moving diagonally forward one square.

Each side sets up its playing pieces as shown in the prior art FIG. 1 with a first player, playing with the lighter color playing pieces, having its king on square 1e, the queen on 1d, the bishops on C1 and F1, the knights on B1 and G1, and the castles on A1 and H1. A row of pawns are placed along row 2 (A2-H2). The second player, playing with the darker color playing pieces at the opposite end of the game board, sets up its playing pieces likewise with its king at square 8e, its queen at 8d, and so on.

Each side takes turn moving one of its respective playing pieces. Similar to Western chess, players strategically capture opponents playing pieces in order to ultimately capture the other player's king. Playing pieces are captured when a playing piece, played in turn, moves onto a square occupied by the other's playing piece. When a player can capture the other player's king, it is called "check." If the player whose king is in check can move its king to a position of safety during its turn or can move another playing piece to block the otherwise capture of the king, the king is then "out of check" and the game continues. But if a player checks its opponent's king and that player can no longer move its king out of check or another playing piece cannot block the checking piece, "check mate" is declared and the player that check mated the other's king is the winner.

In traditional Western chess, captured pieces are removed from the playing area of the board. The lone exception in Western chess is when a player's pawn is "promoted"—a situation whereby a player has successfully moved a single pawn completely across the game board to the other player's first row (e.g., row 8 for the first player or row 1 for the second player). Once a player promotes a pawn, that player regains a previously captured piece and replaces the promoted pawn with the newly recaptured piece (oftentimes the highest ranked piece that was previously captured, such as a queen if available). The new piece begins on the square to which the pawn advanced as was promoted thereby giving the player that promoted pawn a higher ranked piece that may be able to move in a strategic direction closer to where the opponent's king may be situated.

Unlike traditional Western chess, the present invention allows the player who captures an opponent's piece to remove the top portion of the captured piece, such as removing the top portion protuberance from the slot of the bottom portion, and replacing it with a new top portion. Thus, the newly converted piece exhibits visual indication that the captured piece is now a converted piece. The net effect is that the otherwise captured piece does not leave the board, but is now converted to an additional playing piece for the player who made the capture. These converted playing pieces return to their original column (or alternatively row or alternatively original playing square).

This fundamentally changes the dynamics of the game. In a practical sense, there are more playing pieces on the board. It is both harder to get at the other's king as there is not the inevitable reduction of one or both side's pieces as those pieces leave the board. In another sense, the game may be faster as there is less of a "playing field" and one side or another is always losing playing pieces to the other side.

Given that the Western chess is, an allegory for medieval battle, including capturing pieces (taking prisoners) and removing them (sending them to the dungeon or worse), the method of play in the present invention is philosophically different. Instead of "taking prisoners" and sending them off such that they are incapable of battle unless in rare circumstances (promotion of a pawn to a higher ranked piece), the "converted" piece is asked to join the other side. From this perspective, the side that is converting pieces is more analogous to a leader "converting" a person or persons to its point of view. The game itself is not one of battle and annihilation, but one of persuasion such that the opponents king is captured when too many of the other king's team and converts have pressured the other side's leader (king) such that it must move from the pressure, but can no longer move (maintain an old position) within the network of people, including converts and those having contrary and evolving views.

These and other advantages will become more apparent upon review of the Drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

Figure 1:
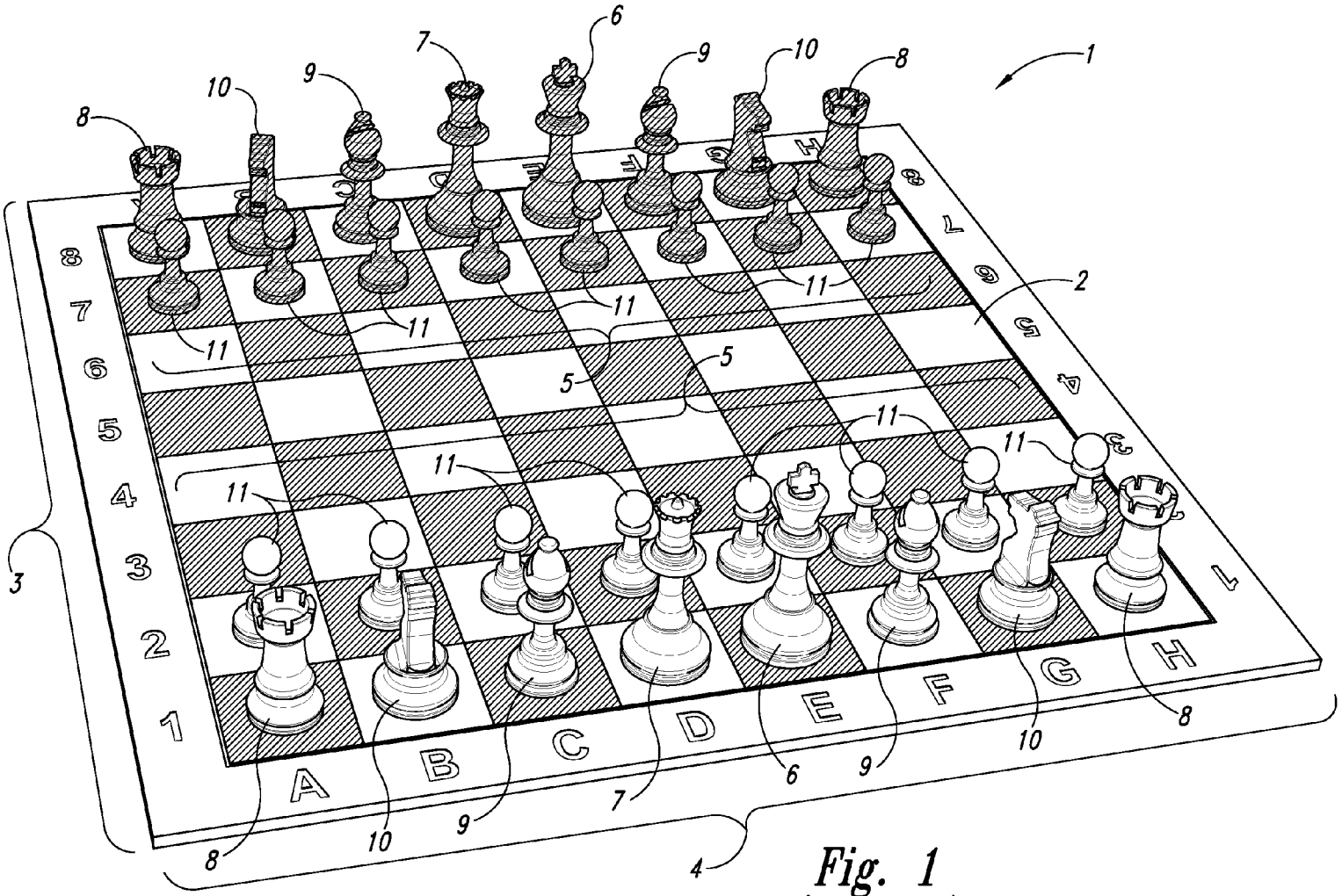
Fig. 1 (Prior Art)
FIG. 1 is a prior art perspective view of a traditional Western chess 64 bi-tonal chessboard for two players with each side having 16 playing pieces including a king, a queen, two bishops, two knights, two castles, and eight pawns and wherein each player's playing pieces are a different color.
Figure 2:
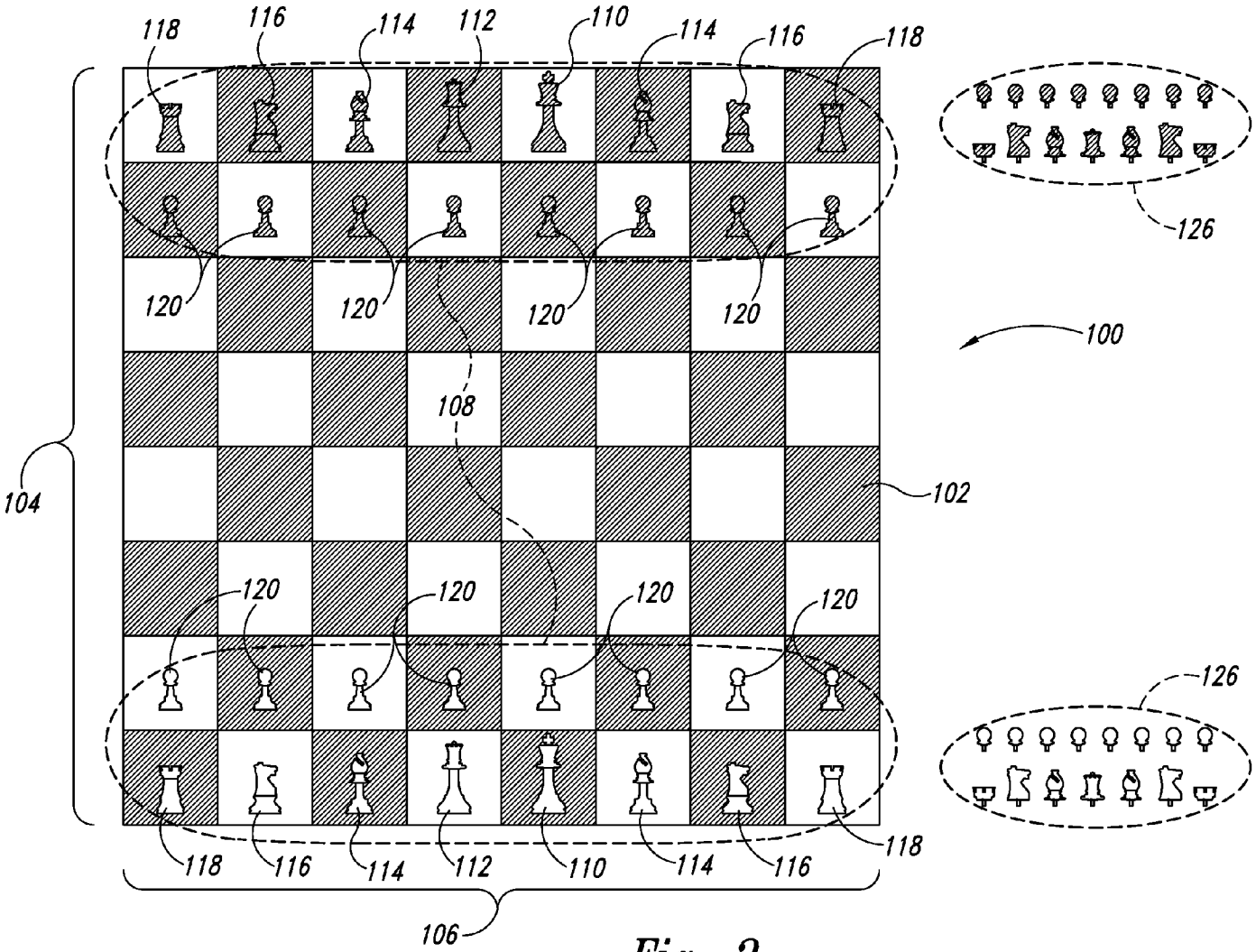
FIG. 2 is a schematic view of a chess layout of the present invention including the game board and two sets of playing pieces similar to Western chess, except that each set includes playing pieces having top and corresponding removable bottom portions and an additional set of top portions corresponding to the bottom portions of the bishops, knights, castles, and pawns, but of a different color than the original set of playing pieces.
Figure 3:
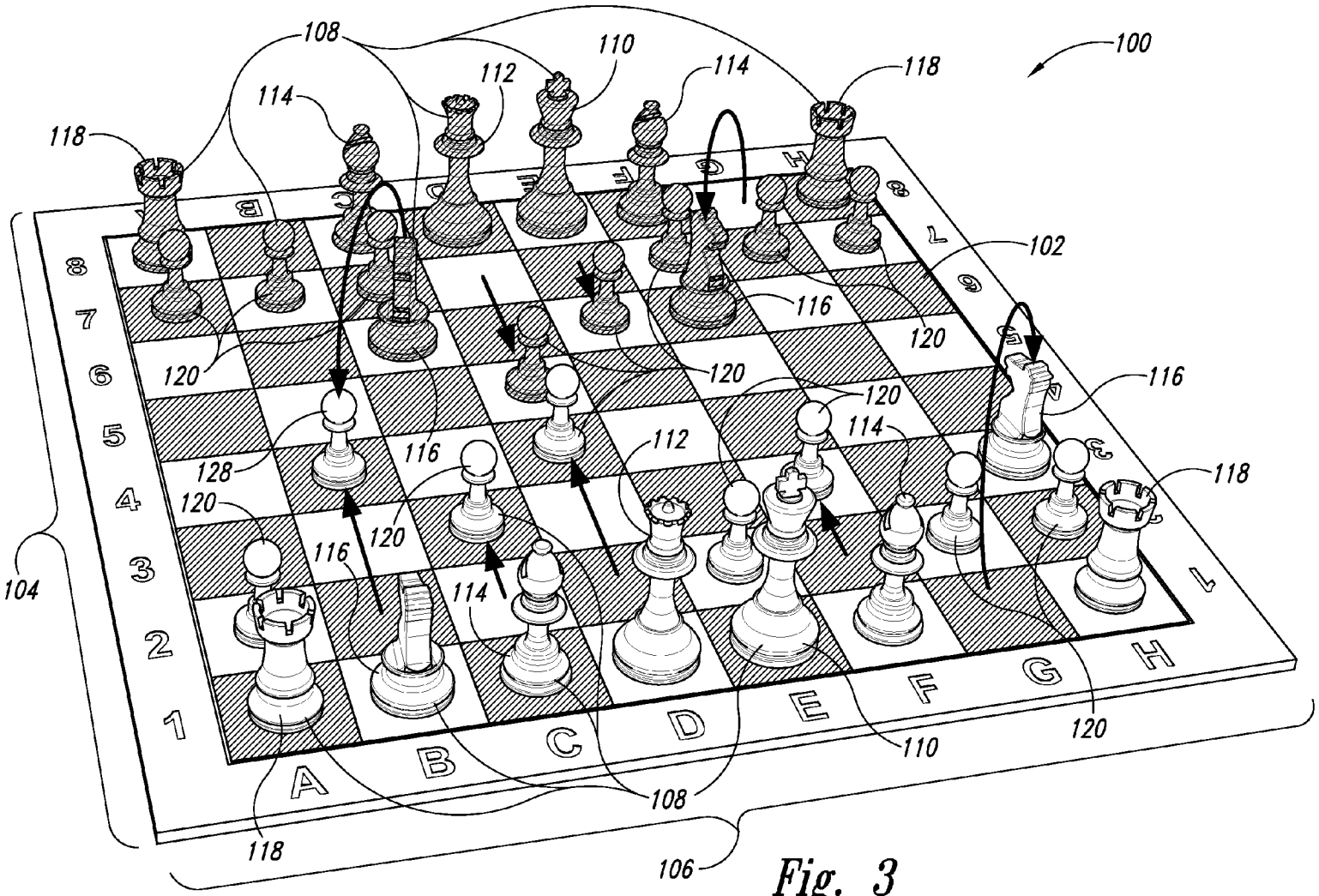
FIG. 3 is a perspective view of a piece (pawn at B4) about to be captured (pre conversion)

Referring to FIGS. 2-19, the present invention is directed to a board game and method of playing a board game between two players that is an improvement on traditional Western chess and Shoji. A game 100 includes a 64-square bi-tonal chessboard 102 having eight rows 104 and eight columns 106, and two sets of playing pieces 108, where each set is of a different color or tone to indicate which pieces belong to a particular player.

Each set 18 is similar to Western chess in that each includes a king 110, a queen 112, two bishops 114, two knights 116, two castles 118 (also called rooks), and eight pawns 120. Each playing piece is ranked where the king is of the highest rank. Next highest is the queen, then the bishops, the knights, the castles, and then the pawns, which are of the lowest rank. Each playing piece has a top portion 122 and a bottom portion 124. Each playing piece is visually identifiable by its rank. While many different sizes and shapes may be envisioned, the traditional Staunton style chess pieces are illustrated as representative pieces.

Figure 4:
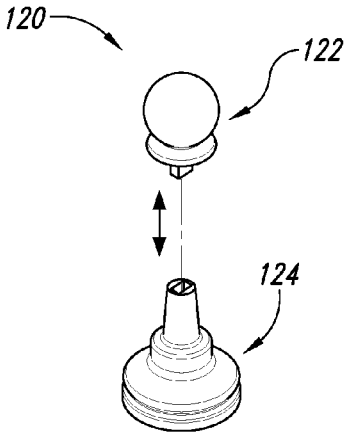
FIG. 4 is a front view of a representative pawn of the present invention having a top portion and a bottom portion.
Figure 5:
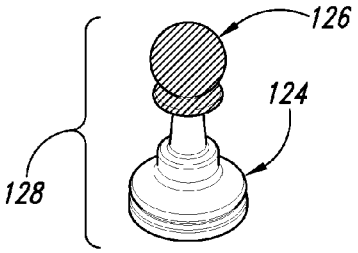
FIG. 5 is a view like that of FIG. 4 except that pawn is now in its converted state in which the original top portion is replaced with the new, different colored, top portion that visibly indicates the playing piece's converted status.

Unlike Western chess, however, each top portion 122 for at least the queen, bishop, knight, castle, and pawn playing pieces, is removable from its corresponding bottom portion 124 in the present invention. Each player also has a second set of top portions 126 that are interchangeable with the original top portions 122 and are configured to engage with the original bottom portions 124. These second set (or new) top portions are of a different color or tone than the original top portion. As illustrated in FIGS. 4 and 5, a playing piece (FIG. 4) may have its top portion 122 replaced with a new, but different-colored, top portion 126 to create a visually distinct playing piece when "converted" such as the converted pawn 128 illustrated in FIG. 5.

Figure 6:
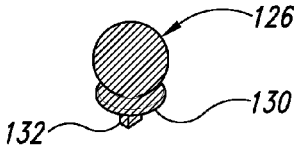
FIG. 6 is a front view of the top portion of the representative pawn, as removed from its corresponding bottom portion, and better illustrating a lower surface of the top portion and a protuberance that extends outwardly from the lower surface.

Referring particularly to FIG. 6, each original top portion 112 and new top portion 126 includes a lower surface 130 and a protuberance 132 that extends outwardly and downwardly from the lower surface 130. The protuberance may be peg-like in shape.

Figure 7:
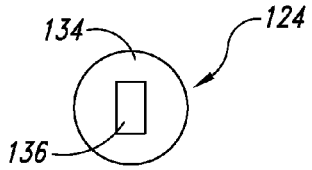
FIG. 7 is a top view of the bottom portion of the representative pawn with the top portion removed with the bottom portion including an upper surface that defines a slot of a size and shape to engage the protuberance of the top portion of FIG. 6.

Referring also to FIG. 7, each bottom portion includes an upper surface 134 that defines a slot 136 or opening of a size and shape to receive the protuberance 132 of the top portion. The original or new top portions are configured to be received into the corresponding bottom portion such that the assembled overall shape is one complete playing piece (e.g., FIG. 4 with the original top portion 122 or FIG. 5 with the new (or second set) top portion 126).

Alternatively, and not illustrated, the invention may encompass where a bottom portion of a playing piece includes a protuberance that extends upwardly and the top portion includes a slot or opening of a size and shape to receive the protuberance from the bottom portion. Other common mechanical joining of the top and bottom portions may be configured (e.g., twist screw top, tongue and groove, hook and latch, hook and loop fasteners) and still be encompassed in the claims of the present invention.

Figure 8:
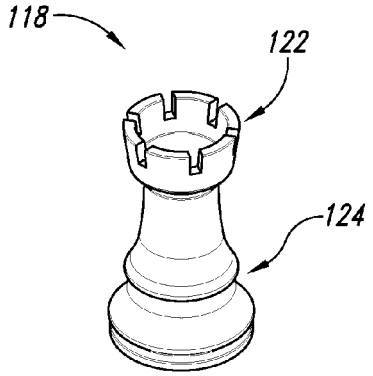
FIG. 8 is front view of a representative castle of the present invention illustrated with its original top portion removed.
Figure 9:
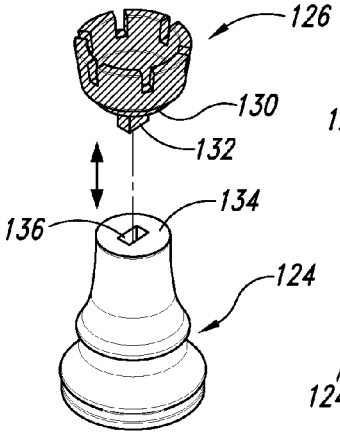
FIG. 9 is a view like FIG. 8 except that the original top portion has been replaced with a new top portion of a different color.
Figure 10:
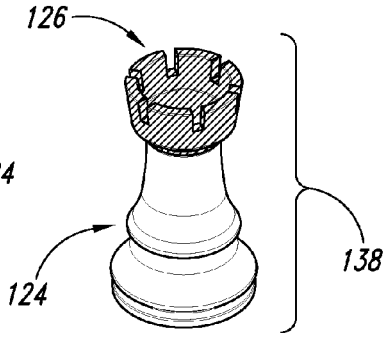
FIG. 10 is a front view of an assembled new top portion and original bottom portion as a converted representative castle might appear during play.
Figure 11:
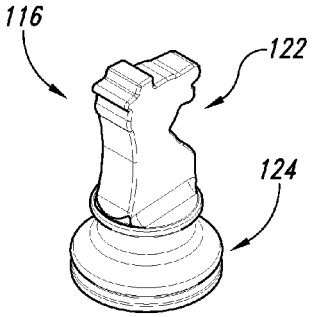
FIG. 11 is a front view of a representative knight having an original top and bottom portion.
Figure 12:
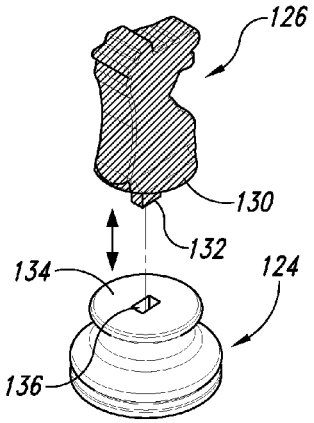
FIG. 12 is a view like that of FIG. 11 except where the top portion is removed from the bottom portion and the original top portion is replaced by a new top portion.
Figure 13:
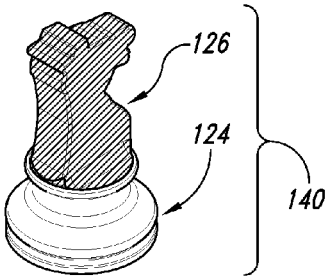
FIG. 13 is a front view of an assembled representative knight upon conversion.
Figure 14:
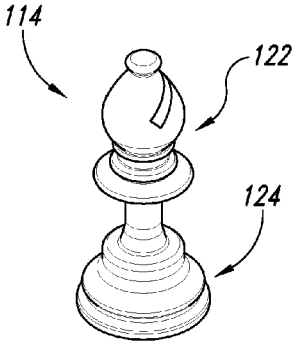
FIG. 14 is a front view of a representative bishop having original top and bottom portions.
Figure 15:
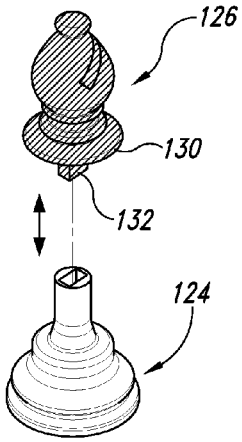
FIG. 15 is a front view like that of FIG. 14 except that the top portion has been removed from the bottom portion and further that the top portion has been replaced by the new top portion.
Figure 16:
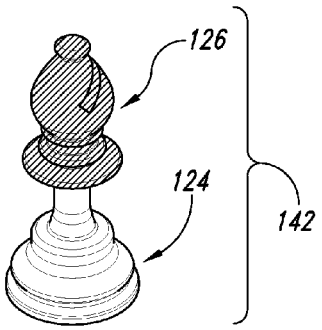
FIG. 16 is a front view of a fully converted representative bishop.
Figure 17:
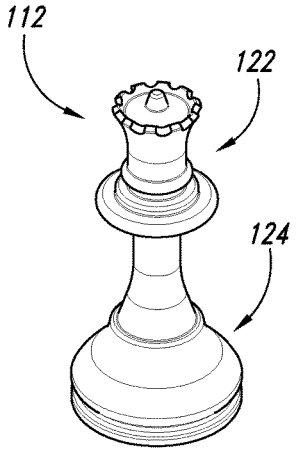
FIG. 17 is a front view of a representative queen having original top and bottom portions.
Figure 18:
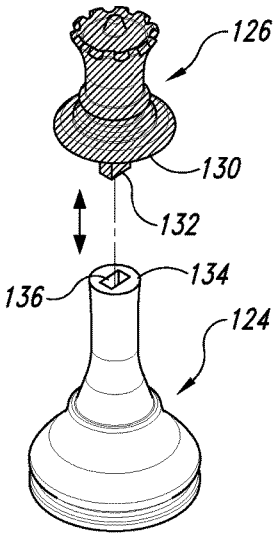
FIG. 18 is a front view like that of FIG. 17 except that the top portion is removed from the bottom portion.
Figure 19:
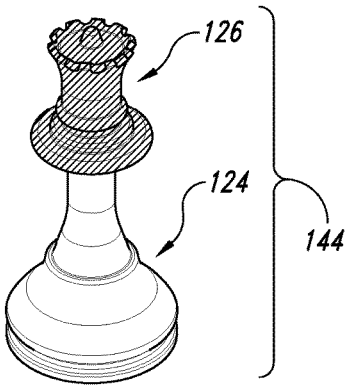
FIG. 19 is a front view of a fully converted representative queen with its new top portion.
Figure 20:
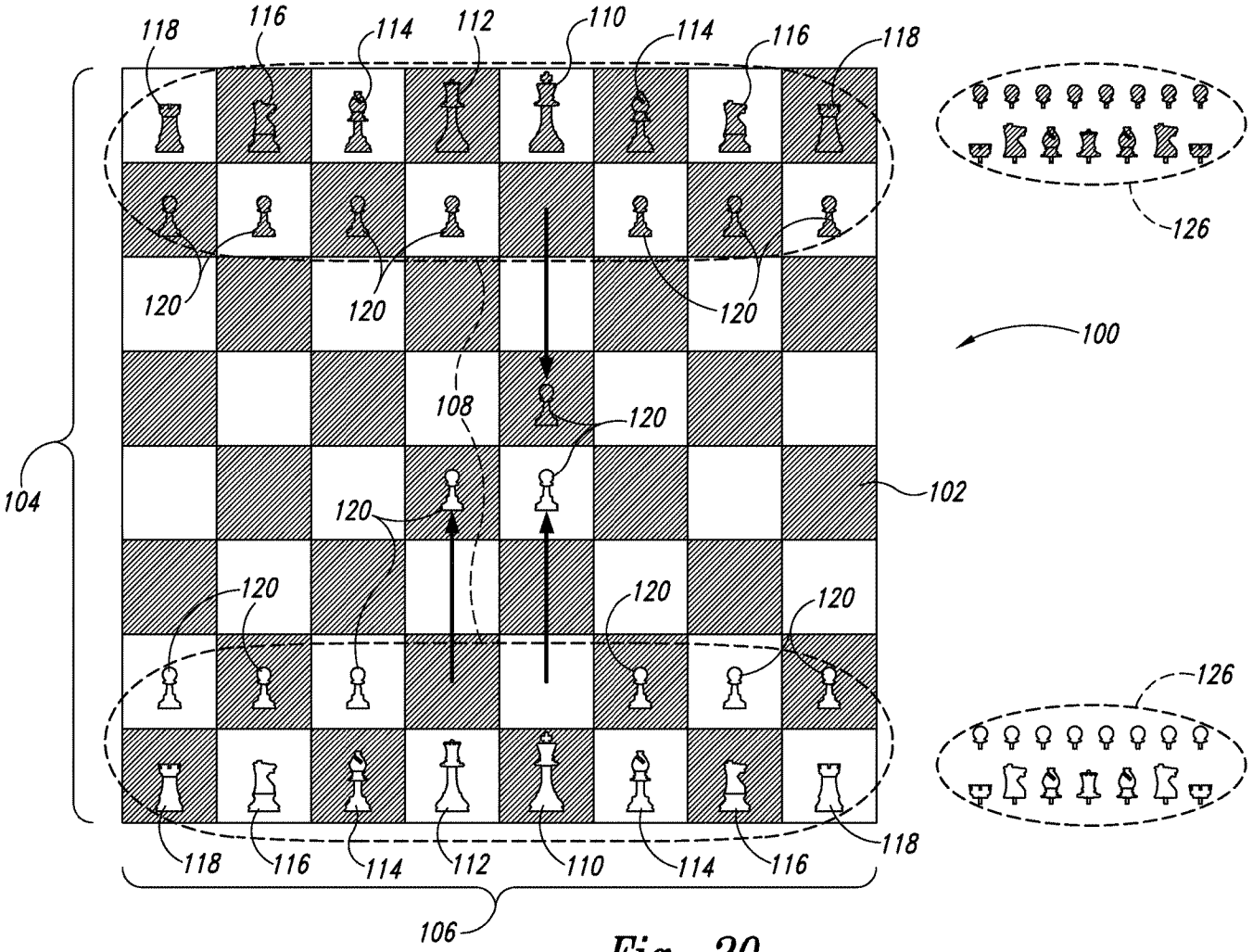
FIG. 20 is a schematic view illustrating the game being played where a representative playing piece (e.g., white pawn at D4) may be captured by another playing piece (e.g., black pawn at E5)
Figure 21:
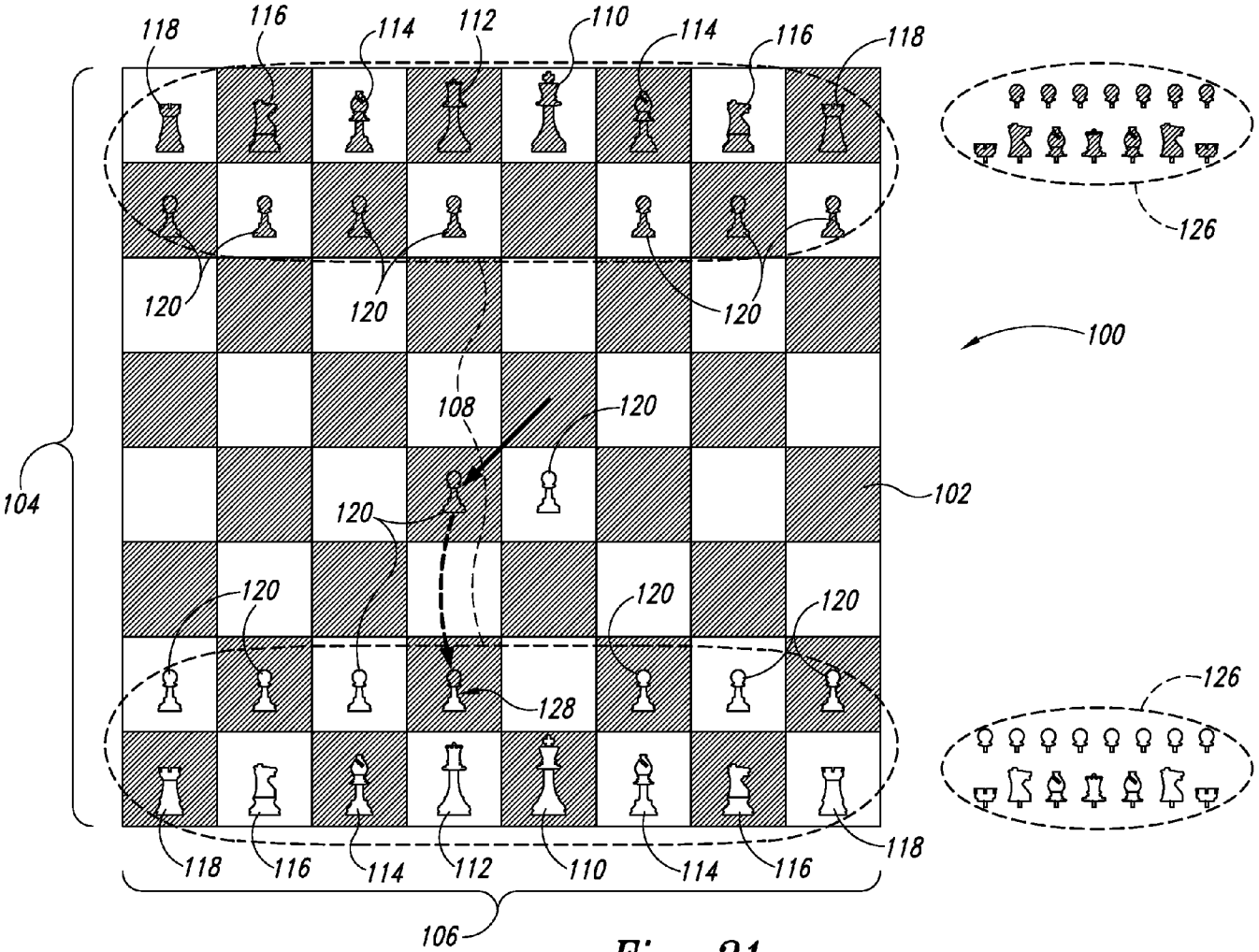
FIG. 21 is a schematic view like that of FIG. 20 and showing the captured playing piece (e.g., pawn of D4), now converted, and returned to its original space (e.g., D2)

FIGS. 8-10 illustrate a castle 118 with both the original top portion 122 and new 126 top portions. FIG. 10 illustrates a representative converted castle 138. Likewise, FIGS. 11-13 illustrate an original (or first set) knight 116 and a representative converted knight 140. FIGS. 14-16 illustrate original bishop 114 and representative converted bishop 142. And FIGS. 17-19 illustrate original (unconverted) queen 112 and representative converted queen 144. As discussed below, the object of the game is to checkmate the other player's king and as such there is no need for a converted king. However, the king may or may not have the removable top and bottom portions if manufacturing the set in a similar style is desired for uniformity or ease in manufacturing.

Referring again to FIG. 2, the present invention also includes a method of playing a game that includes the playing pieces described above. The game pieces are set up like Western chess where the first player sets its king on game square E1, the queen on D1, the two bishops on squares C1 and F1, the two knights on squares B1 and G1, and the two castles on A1 and H1. The first player's pawns are set up across row 2. The second player sets up its pieces likewise with the king in position E8, the queen in D8, the bishops in C8 and F8, the knights in B8 and G8, and the castles in A8 and H8. The second player's pawns are set across row 7.

Referring now to FIGS. 20-23, the playing pieces also move like Western chess pieces. Pawns advance in one forward direction, one space at a time, except the first time the pawn is moved it may optionally move two squares or that it may move diagonally one square to convert the other player's piece that happens to be in such a square diagonal and forward of the other player's pawn. Castles move horizontally or vertically. Knights move in an "L" shape either two squares up or down and one square sideways or vice-versa. Bishops move diagonally. Queens can move vertically, horizontally, and diagonally. Kings can move in all directions, but only one move at a time.

Similar to Western chess, players take turns moving one piece at a time. Each player strategizes how to move its pieces such that it attacks (put into "check") the other player's king.

Also similar to Western chess, the object of the game is to "checkmate" the king and that person is declared the winner. Checkmate is the state in which the king is otherwise in a "captured" state (placed into check by the other player through at least one playing piece) but where the king cannot move into another square or otherwise move one of its playing pieces to otherwise block being in check. This is the final state where the king is fully captured and the game ends.

In play, if a player moves its playing piece to one occupied by the opponent's piece it would be "captured" under Western chess rules. The piece would be removed from the board and the player whose playing piece was captured and removed must play with one less playing piece. But in the present invention, the playing piece is "converted," not captured. The playing piece's original top portion 122 is removed and replaced with the new top portion 126. The new top portion provides visual indication that it is a converted piece. Here, conversion means that the playing piece stays on the board and remains a playing piece of the same rank, but is now a playing piece for the player that converted it.

If a pawn starts the game at D2, and subsequently makes various moves and later converted, and given a differently colored top portion, it should be returned to square D2 (or alternatively any other available square space in column 2, any available space D1 through D8). If square D2 or the other square spaces in column D are already occupied, then the converted piece should be kept off to one side of the board until a space opens for it to safely occupy, as in Shogi. (See for example, FIG. 23). Converted pieces return to their starting positions at the beginning of the game or to an unoccupied square in the column from which they started. So a converted rook (or castle) would ideally be returned to A1 or H1 (or any open square in column A if A1 or AH are occupied); a converted knight returned to B1 or G1 (or any available square in column 1); a converted bishop returned to C1 or F1 (or any available square in column 1); and a converted queen to D1 (or any available square in column D). If those squares are occupied or would put the converted piece in danger of being captured/converted again, the player has the option of leaving it to the side of the board until a safer space opens. If its original square at the start of the game is occupied, the converted piece can be place on another unoccupied square in that column.

Figure 22:
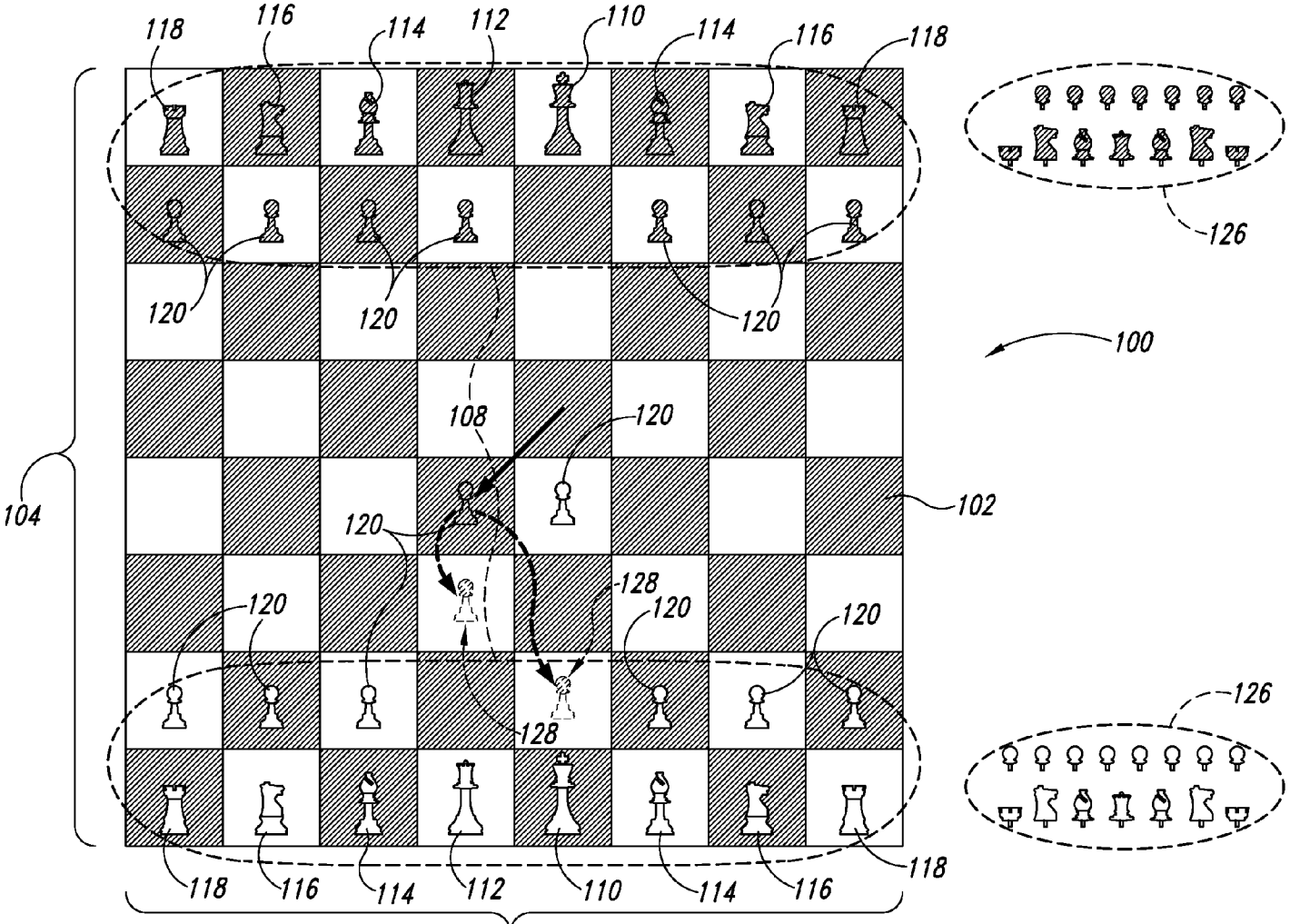
FIG. 22 is a schematic view like that of FIG. 21 and showing an alternative method of play where the captured pawn at D4 may be replaced on any available square of its original column (column D) or, alternatively, original row 2.

Alternatively, the game can be played where a converted piece is replaced anywhere there is a space from the original row (as opposed to column). FIG. 22 attempts to illustrate the two alternative paths (columns or rows).

Figure 23:
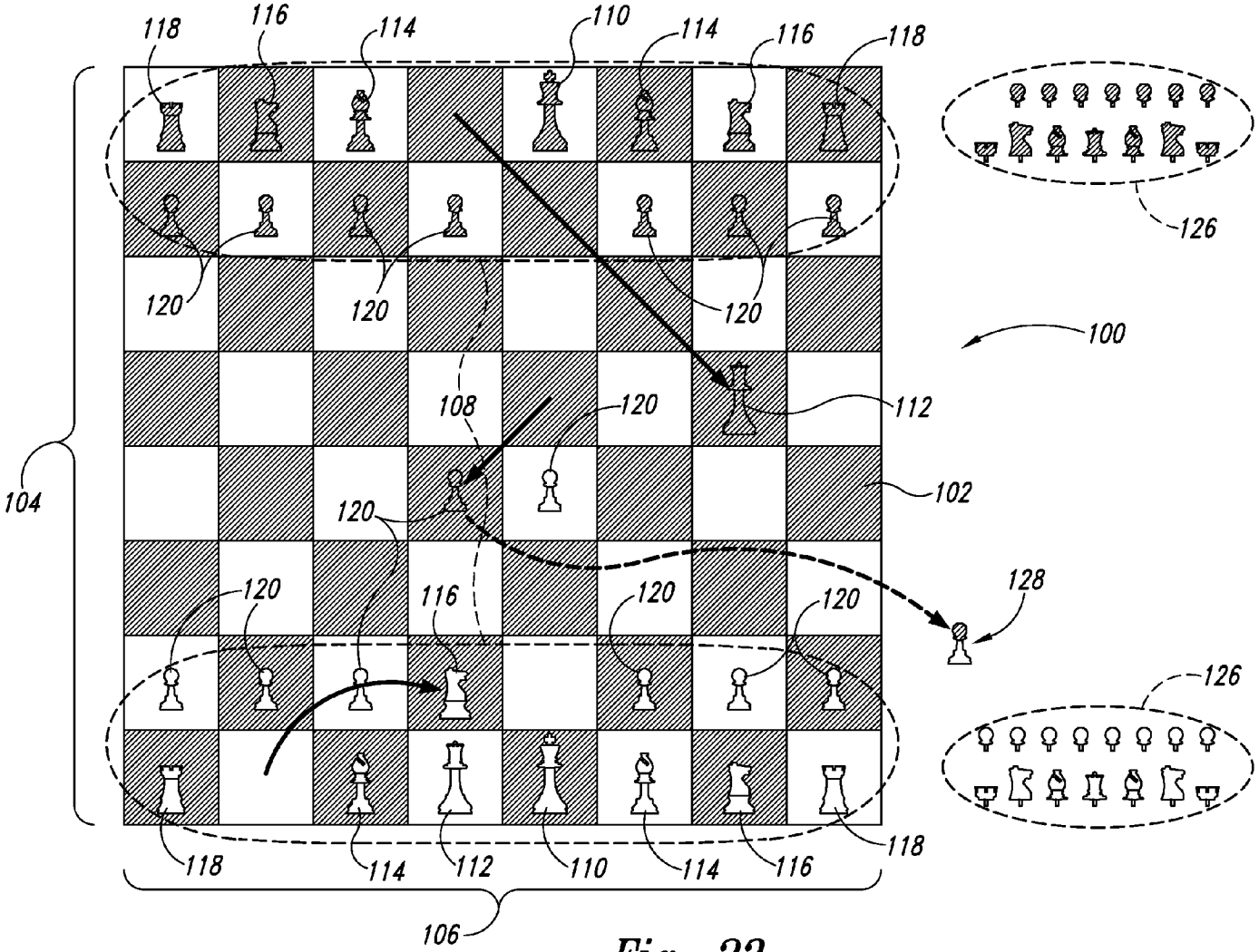
FIG. 23 is a schematic view like that of FIG. 21 where a converted playing piece stays off the board until such time that the original square opens up.

As illustrated in FIG. 23, captured pieces do not leave the board unless a space on the original square is occupied (or in the alternate method of play in the occupied column or row, not illustrated in FIG. 23). Once the original square is opened again (here, D2 in the illustration), converted playing piece 128 is replaced at D2. The tactics for moving one's playing pieces will vary since playing pieces do not leave the board as they would when "captured" under Western chess. Thus the game is more challenging and potentially quicker.

According to one aspect of the game, the new top portions correspond to two colors (or tones) of the playing piece sets. The player that converts an opponent's playing piece removes the top portion of the converted piece and replaces it with a new top portion having the same color (or tone) as the player's pieces. In such manner, the top portion is the same color as the rest of the original top and bottom portions so as to quickly make a converted piece identifiable.

The present invention game of "conversion" as opposed to "capture" provides a distinct change in game philosophy. Conversion is not based on "annihilation," but can be characterized as persuasion and be a metaphor for more peaceful coexistence and a philosophy that is based on communication, rather than domination.

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that his patent rights not be limited by the particular embodiments illustrated and described herein, but rather by the following claims interpreted according to accepted doctrines of claim interpretation, including the Doctrine of Equivalents and Reversal of Parts.

What is claimed is:

1. A method of playing a two-dimensional board game, the game having a single tier playing space and multiple playing pieces positioned on the single tier playing space, the playing pieces having roles defined by advancing, capturing, and converting capabilities, the method comprising:

providing a plurality of playing pieces for two players, each of the playing pieces being capable of advancing, capturing, and conversion; one of each player's playing pieces being an ultimate piece; the remaining playing pieces for both players being role-altering playing pieces;

each said role-altering playing piece being configured with a base portion that confronts the playing space, and a removable and convertible top member having a universal post configured to be seated into an upper portion of the base portion of each playing piece; wherein all of the playing pieces are further defined by two distinct visual characteristics with one half of the playing pieces having one visual characteristic denoting ownership to a first of the two players and other half having a second visual characteristic denoting ownership to a second of the two players; and further wherein each role-altering playing piece has its base portion and convertible top member of the same visual characteristic in a first role and the convertible top member is configured to be replaced with another convertible top member of the other visual characteristic in a second role to form a hybrid characteristic and denote a change of ownership from one player to the other yet still having the same advancing, capturing, and converting capabilities as the playing piece had prior to conversion; and altering between the first and second roles whenever the role-altering playing pieces participate in capture and conversion and wherein role altering takes place when one player's playing piece captures and converts the other player's playing piece;

wherein the playing space further comprises a board arranged with 64 bi-tonal squares arranged into one large square having eight rows and eight columns with one tone adjacent another tone forming a uniformly arranged bi-tonal grid, and wherein advancement, capturing, and conversion takes place on the squares of the playing space; and wherein each player is given 16 playing pieces and each player's playing pieces occupy only one original square on an original column and an original row prior to advancement and advancement takes place when a playing piece is moved to another square; and wherein capturing and converting takes place where an advancing playing piece advances to a square that is already occupied with the other player's playing piece.

2. The method according to claim 1 wherein converted playing pieces are placed on their respective original playing square if unoccupied.

3. The method according to claim 2 wherein converted pieces leave the board if their respective original squares are occupied and wait to return when the original square positions open.

4. The method according to claim 1 wherein converted pieces leave the board if their respective original column is all filled and wait to return said converted pieces to the board when a square on the original column opens.

5. The method according to claim 1 wherein converted playing pieces are placed on an unoccupied square of their respective original row.

6. The method according to claim 1 wherein the two distinct visual characteristics are two distinct colors.

7. The method according to claim 1 wherein a playing piece of one of the two players is captured and converted with its replaced convertible top member with the other visual characteristic and returned to the same position on the playing space.

* * * * *